US009561644B1

(12) United States Patent
Clark et al.

(10) Patent No.: US 9,561,644 B1
(45) Date of Patent: Feb. 7, 2017

(54) SYSTEM AND METHOD FOR COMPENSATING FOR MALFUNCTIONING INKJETS

(71) Applicant: Xerox Corporation, Norwalk, CT (US)

(72) Inventors: Raymond J. Clark, Webster, NY (US); Roger L. Triplett, Penfield, NY (US); Stuart A. Schweid, Pittsford, NY (US); Martin L. Frachioni, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/074,137

(22) Filed: Mar. 18, 2016

(51) Int. Cl.
*B41J 2/045* (2006.01)
*B41J 2/21* (2006.01)

(52) U.S. Cl.
CPC ..... *B41J 2/04506* (2013.01); *B41J 2/04586* (2013.01); *B41J 2/2103* (2013.01); *B41J 2/2139* (2013.01)

(58) Field of Classification Search
CPC ... B41J 2/04506; B41J 2/04586; B41J 2/2103; B41J 2/0451; B41J 2/04508; B41J 2/2139; B41J 2/2142; B41J 2002/022
See application file for complete search history.

(56) References Cited

U.S. PATENT DOCUMENTS

| | | | | |
|---|---|---|---|---|
| 5,581,284 | A | 12/1996 | Hermanson | |
| 6,695,435 | B1 | 2/2004 | Cheng et al. | |
| 7,422,299 | B2 | 9/2008 | Mantell et al. | |
| 8,419,160 | B2 | 4/2013 | Mantell et al. | |
| 9,186,887 | B1 * | 11/2015 | Mantell | H04N 1/4015 |

* cited by examiner

*Primary Examiner* — Thinh H Nguyen
(74) *Attorney, Agent, or Firm* — Maginot Moore & Beck LLP

(57) ABSTRACT

A method and system compensates for malfunctioning inkjets using contone values for an image prior to the contone values being rendered for printing of the image. The method generates contone values for color space components in a compensation level for each malfunctioning inkjet. The contone values in each compensation level are modified with reference to a profile selected for each malfunctioning inkjet and with reference to the modification of the contone values in the vicinity of each malfunctioning with the compensative level. The modified contone values of each compensation level are merged with the contone values in the vicinity of each malfunctioning inkjet. The contone values are then rendered and used to operate inkjets for forming an ink image on an ink receiving member.

20 Claims, 3 Drawing Sheets

SYSTEM AND METHOD FOR COMPENSATING FOR MALFUNCTIONING INKJETS

TECHNICAL FIELD

The system and method disclosed in this document relate to printers that distribute marking material with reference to image data and, more particularly, to compensating for malfunctioning ejectors in such printers.

BACKGROUND

Drop on demand inkjet technology for producing printed media has been employed in commercial products such as printers, plotters, and facsimile machines. Generally, an ink image is formed by selectively ejecting ink drops from a plurality of inkjets, which are arranged in a printhead or a printhead assembly, onto an image receiving surface. For example, the printhead assembly and the image receiving surface are moved relative to one other and the inkjets are operated to eject ink drops onto the image receiving surface at appropriate times. The timing of the inkjet activation is performed by a printhead controller, which generates firing signals that activate the inkjets to eject ink. The image receiving surface may be an intermediate image member, such as a print drum or belt, from which the ink image is later transferred to a print medium, such as paper. The image receiving surface may also be a moving web of print medium or a series of print medium sheets onto which the ink drops are directly ejected. The ink ejected from the inkjets may be liquid ink, such as aqueous, solvent, oil based, UV curable ink or the like, which is stored in containers installed in or near the printer. Alternatively, the ink may be loaded in a solid form that is delivered to a melting device, which heats the solid ink to its melting temperature to generate liquid ink that is supplied to a print head.

During the operational life of these imaging devices, inkjets in one or more printheads may become unable to eject ink in response to a firing signal. These inoperative inkjets are also called malfunctioning inkjets or ejectors. Because printing systems typically have on the order of fifty to one hundred thousand inkjets, some malfunctioning inkjets are almost always present in the system. The defective condition of the inkjet may be temporary and the inkjet may return to operational status after one or more image printing cycles. In other cases, the inkjet may not be able to eject ink until a purge cycle is performed. A purge cycle may successfully unclog inkjets so they are able to eject ink once again. Execution of a purge cycle, however, requires the imaging device to be taken out of its image generating mode. Thus, purge cycles affect the throughput rate of an imaging device and are preferably performed during periods in which the imaging device is not generating images. The printing device must be able to function routinely with some number of malfunctioning inkjets.

Methods have been developed that enable an imaging device to generate images even though one or more inkjets in the imaging device are unable to eject ink. These methods cooperate with image rendering methods to control the generation of firing signals for inkjets in a printhead. Rendering refers to the processes that receive input image data values in one form convenient to the user or upstream portion of the system and then process these received data accurately into output image data values that express the image in another form convenient for the downstream system, typically an electromechanical marking engine. The output image data values are used to generate firing signals for printheads to cause the inkjets to eject ink onto the recording media. Once the output image data values are generated, a method may use information regarding defective inkjets detected in a printhead to identify the output image data values that correspond to a defective inkjet in a printhead. The method then searches to find a neighboring or nearby output image data value that can be replaced to compensate for the defective inkjet. Another method is able to compensate for the defective inkjet because a normalization process may be used to establish a maximum output image data value for inkjets that is less than the output image data value that causes an inkjet to eject the maximum amount of ink that can be ejected by an inkjet. Thus, an output image data value can be increased beyond the normalized maximum output image data value to enable an inkjet to eject an amount of ink corresponding to the maximum output image data value plus some incremental amount. By firing several nearby inkjets in this manner, the ejected ink density can approximate the ink mass that would have been ejected had the defective inkjet been able to eject the ink for an output image data value that corresponds to the defective inkjet. Another method may rely on the configuration of printheads in the printer that enables inkjets that eject ink drops of different colors at a same position on the substrate that receives the ink drops. When one of these inkjets that eject drops at the same position malfunctions, some of the ink that would have been ejected by the malfunctioning inkjet is provided by ejecting drops from one of the other functioning inkjets that eject ink onto the same location that the malfunctioning inkjet would eject ink.

The methods that compensate for malfunctioning inkjets by adding all or a portion of an output image data value associated with the malfunctioning inkjet to output image data values associated with nearby operating inkjets in the same printhead are effective. The ink drops ejected by the nearby inkjets are reasonably well aligned with the other ink drops in the same area since they are ejected by the same printhead. Additionally, the ink drops are the same color as those ink drops that would be ejected by the malfunctioning inkjet. This method requires, however, that approximately 20% of the inkjets nearby the malfunctioning inkjet have zero or nearly zero output image data values in order for a sufficient number of locations be available for accepting all or a portion of the output image data value for the malfunctioning inkjet to mask the absence of the ink to be ejected by the malfunctioning inkjet. Consequently, this method is not capable of compensating for malfunctioning inkjets that would eject ink drops into high density regions of an image. The method that ejects ink drops from another printhead that is different than the printhead containing the malfunctioning inkjet can eject ink drops in high density areas at the position where the malfunctioning inkjet would eject ink drops; however, the effectiveness of this approach is degraded because the ink drops from the inkjets in the alternative printhead are imperfectly aligned with the malfunctioning inkjet. Thus, a thin line of high optical density contrast tends to occur, which produces a visible streak in the final image. Additionally, the compensating ink is not the same color as the ink that would be ejected by the malfunctioning inkjet. Because the human visual system is less sensitive to high frequency variations in hue and saturation than it is to variations in intensity, this color imperfection is preferred to marking nothing at all in the position of the malfunctioning jet. Nevertheless, these compensating ink drops are a different color than the ink drops that would be ejected by the malfunctioning inkjet and may affect the hue and color saturation of the image in a humanly perceptible manner. Therefore, developing a compensation scheme for malfunctioning inkjets that enables compensation in high density areas without producing humanly perceptible or objectionable image quality issues would be useful.

SUMMARY

A method that compensates for a malfunctioning inkjets in a printhead includes receiving a plurality of contone values for an image to be formed by the printer, receiving data identifying malfunctioning inkjets in the printer, modifying contone values within the plurality of contone values that are positioned about each contone pixel corresponding to one of the malfunctioning inkjets identified by the received data to produce modified contone values for the image to be formed by the printer, rendering the modified contone values and the contone values in the plurality of contone values to produce rendered data, and operating inkjets within the printer with reference to the rendered data to eject ink and form the image.

A printer that implements the method for compensating for a malfunctioning inkjets includes a plurality of printheads configured to eject inks of different colors, a memory configured to store a plurality of contone values for forming an image with ink ejected by the plurality of printheads and data identifying malfunctioning inkjets in the printer, and a controller operatively connected to the plurality of printheads and the memory. The controller is configured to receive from the memory a plurality of contone values for an image to be formed by the printer, receive from the memory data identifying malfunctioning inkjets in the printer, modify contone values within the plurality of contone values that are positioned about each contone pixel corresponding to one of the malfunctioning inkjets identified by the received data to produce modified contone values for the image to be formed by the printer, render the modified contone values and the contone values in the plurality of contone values to produce rendered data, and operate inkjets within the printer with reference to the rendered data to eject ink and form the image.

BRIEF DESCRIPTION OF THE DRAWINGS

The foregoing aspects and other features of a system and method for compensating for a malfunctioning inkjet in a printhead are explained in the following description, taken in connection with the accompanying drawings.

DETAILED DESCRIPTION

Figure 1:
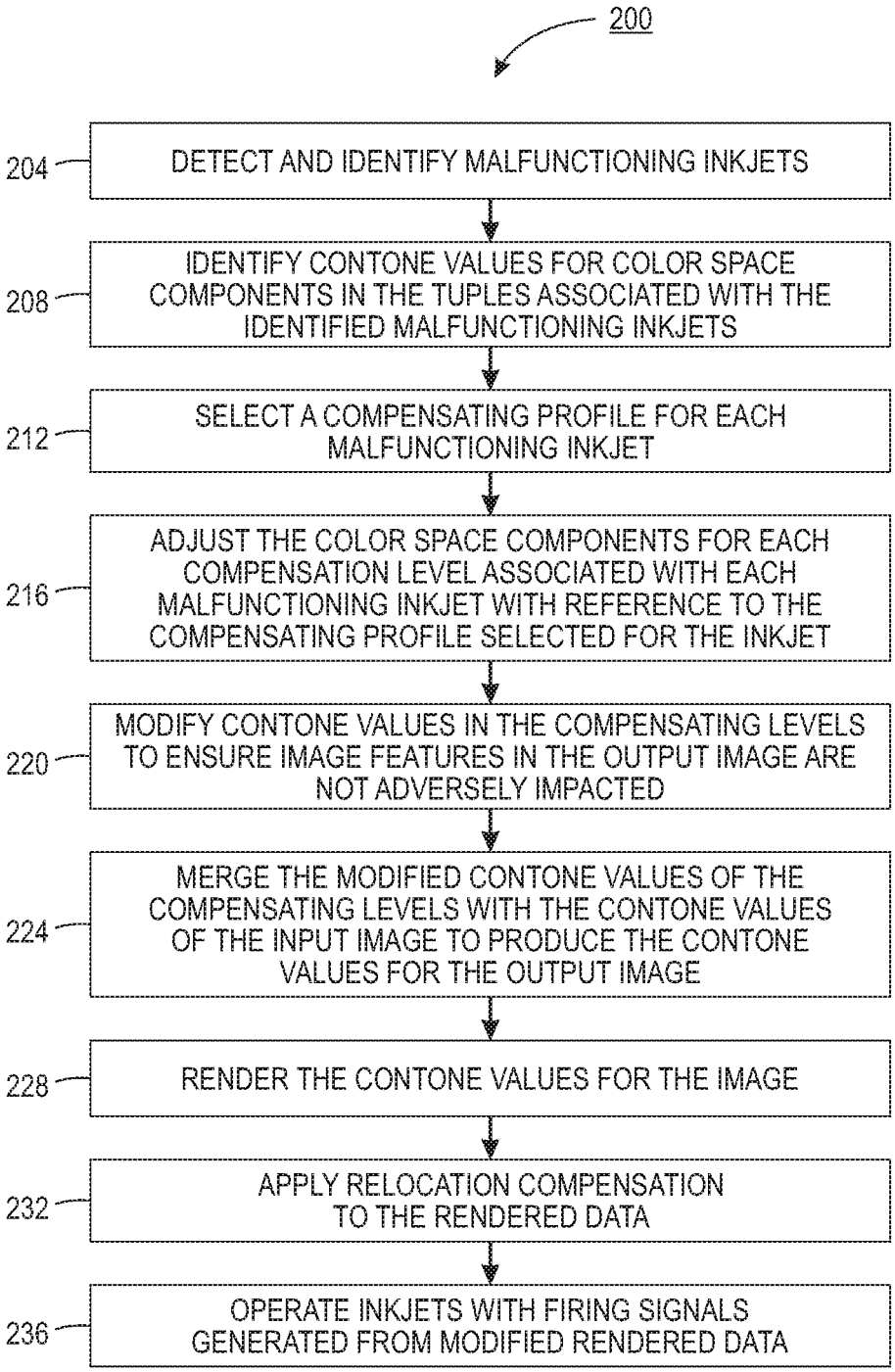
FIG. 1 is a flow diagram of a method that compensates for malfunctioning inkjets in a printhead.

For a general understanding of the environment for the system and method disclosed herein as well as the details for the system and method, reference is made to the drawings. In the drawings, like reference numerals designate like elements.

Figure 3:
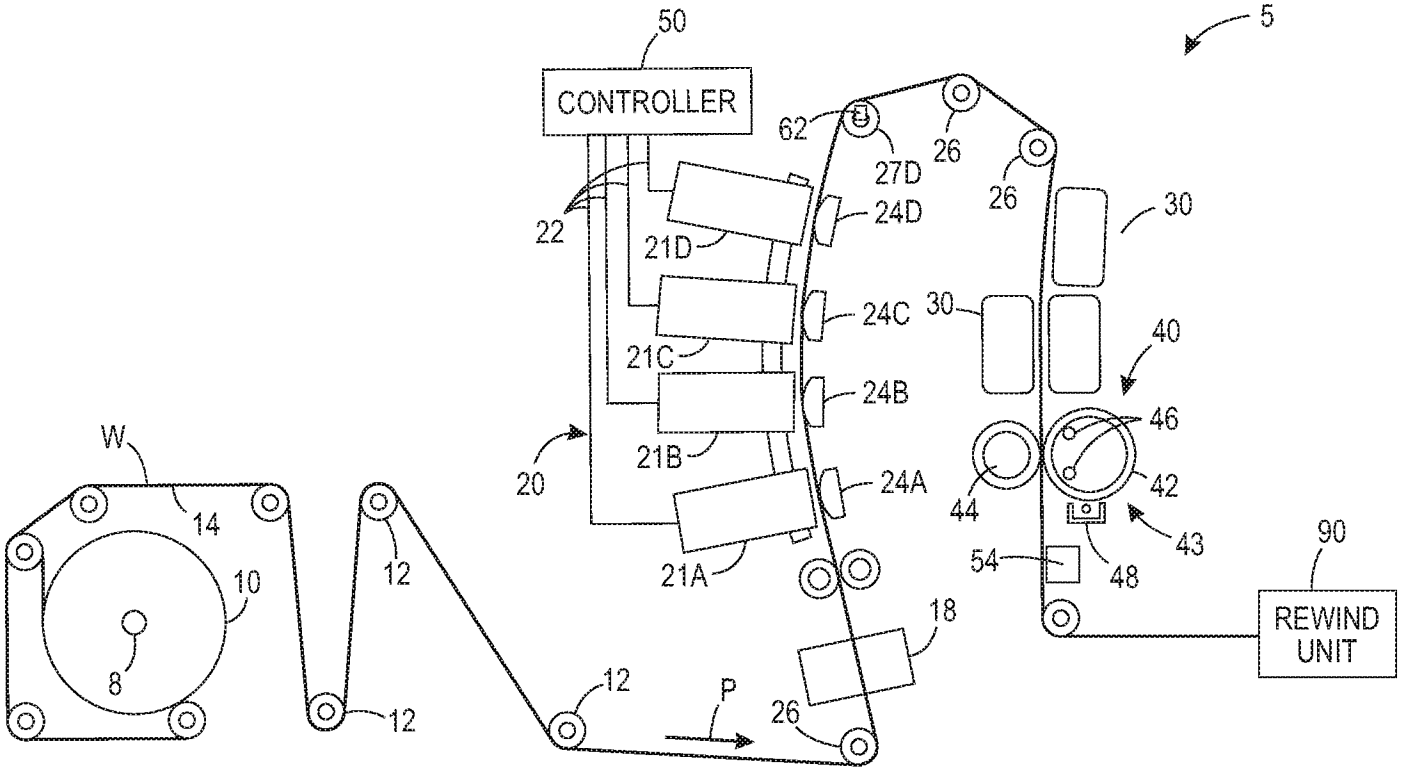
FIG. 3 PRIOR ART
FIG. 3 is a block diagram of a prior art printer in which the method of FIG. 1 can be implemented.

FIG. 3 is a simplified schematic view of the direct-to-sheet, continuous-media, prior art inkjet printer 5, that is configured to produce ink images on a web using a plurality of printheads positioned in a print zone in the printer. A media supply and handling system is configured to supply a long (i.e., substantially continuous) web of media 14 of "substrate" (paper, plastic, or other printable material) from a media source, such as a spool of media 10 mounted on a web roller 8. For simplex printing, the printer includes the web roller 8, print zone or printing station 20, and rewind unit 90. The rewind unit 90 is configured to wind the web onto a roller for removal from the printer and subsequent processing.

The media can be unwound from the source 10 as needed and propelled by a variety of motors, not shown, rotating one or more rollers 12. The rollers 12 control the tension of the unwinding media as the media moves along a path through the printer. In alternative embodiments, the media can be transported along the path in cut sheet form in which case the media supply and handling system can include any suitable device or structure that enables the transport of cut media sheets along an expected path through the imaging device. A pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature, which in one practical embodiment, is in a range of about 30° C. to about 70° C.

The media are transported through a printing station 20 that includes a series of color units 21A, 21B, 21C, and 21D, each color unit effectively extending across the width of the media and being able to place ink directly (i.e., without use of an intermediate or offset member) onto the moving media. The controller 50 is operatively connected to the color units 21A-21D through control lines 22. Each of the color units 21A-21D includes a plurality of printheads positioned in a staggered arrangement in the cross-process direction over the media web 14. As is generally familiar, each of the printheads can eject a single color of ink, one for each of the colors typically used in four color printing, namely, cyan, magenta, yellow, and black (CMYK). The controller 50 of the printer receives velocity data from encoders mounted proximately to rollers positioned on either side of the portion of the path opposite the four printheads to compute the position of the web as moves past the printheads. The controller 50 uses these data to generate timing signals for actuating the inkjets in the printheads to enable the four colors to be ejected with a reliable degree of accuracy for registration of the differently color patterns to form four primary-color images on the media. The inkjets actuated by the firing signals correspond to image data processed by the controller 50. The image data can be transmitted to the printer, generated by a scanner (not shown) that is a component of the printer, or otherwise electronically or optically generated and delivered to the printer. In various alternative embodiments, the printer 5 includes a different number of color units and can print inks having colors other than CMYK.

In the printer 5, each of the printhead units 21A-21D includes one or more printhead controllers that generate electrical firing signals to control the operation of the inkjets in each of the printheads. The printheads are configured to eject liquid ink onto the web as the web passes through the print zone. As used herein, "liquid ink" refers to melted solid ink, heated gel ink, or other known forms of ink, such as aqueous inks, ink emulsions, ink suspensions, ink solutions, or the like. Associated with each of color units 21A-21D is a corresponding backing member 24A-24D, respectively. The backing members 24A-24D are typically in the form of a bar or roll, which is arranged substantially opposite the printhead on the back side of the media. Each backing member is used to position the media at a predetermined distance from the printhead opposite the backing member. In the embodiment of FIG. 3, each backing member includes a heater that emits thermal energy to heat the media to a predetermined temperature which, in one practical embodiment, is in a range of about 40° C. to about 60° C. The various backer members can be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media web 14 moves to receive inks of various colors from the printheads of the print zone 20, the printer 5 maintains the temperature of the media web within a given range. The printheads in the color units 21A-21D eject ink at a temperature typically significantly higher than the temperature of the media web 14. Consequently, the ink heats the media. Therefore, other temperature regulating devices may be employed to maintain the media temperature within a predetermined range. For example, the air temperature and air flow rate behind and in front of the media may also impact the media temperature. Accordingly, air blowers or fans can be utilized to facilitate control of the media temperature. Thus, the printer 5 maintains the temperature of the media web 14 within an appropriate range for the jetting of all inks from the printheads of the print zone 20. Temperature sensors (not shown) can be positioned along this portion of the media path to enable regulation of the media temperature.

Following the print zone 20 along the media path, the media web 14 moves over guide rollers 26 to one or more "mid-heaters" 30. A mid-heater 30 can use contact, radiant, conductive, or convective heat to control a temperature of the media. Depending on the temperature of ink and paper at rollers 26, this "mid-heater" can add or remove heat from the paper and ink. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 applies heat, pressure, or a combination of heat and pressure to the media to fix the images to the media. The fixing assembly 40 includes any suitable device or apparatus for fixing images to the media including heated or unheated pressure rollers, radiant heaters, heat lamps, and the like. In an embodiment that uses melted solid ink to produce images, the fixing assembly includes a "spreader" 43, that applies a predetermined pressure, and in some implementations, heat, to the media. The function of the spreader 40 is to take what are essentially droplets, strings of droplets, or lines of ink on web 14 and spread them out by pressure and, in some systems, heat, so that spaces between adjacent drops are filled and image solids become uniform. In addition to spreading the ink, the spreader 40 also improves image permanence by increasing ink layer cohesion or by increasing the ink-web adhesion. The spreader 43 includes rollers, such as image-side roller 42 and pressure roller 44, to apply heat and pressure to the media. Either roller can include heat elements, such as heating elements 46, to bring the web 14 to a temperature in a range from about 35° C. to about 80° C. In alternative embodiments, the fixing assembly can be configured to spread the ink using non-contact heating (without pressure) of the media after the print zone. Such a non-contact fixing assembly uses any suitable type of heater to heat the media to a desired temperature, such as a radiant heater, UV heating lamps, and the like. In another printer embodiment that employs aqueous ink, the fixing assembly 40 does not include a spreader, such as the spreader 40, but includes one or more heaters that dry aqueous ink on the media web after the media web passes through the print zone 20. In a UV ink printer embodiment, the fixing assembly 40 includes UV light sources that direct UV radiation at the ink to cross-link and fix the ink to the surface of the media web.

The spreader 40 also includes a cleaning/oiling station 48 associated with image-side roller 42. The station 48 cleans and applies a layer of some release agent or other material to the roller surface. In the printer 5, the release agent material is an amino silicone oil having viscosity of about 10-200 centipoises. Only small amounts of oil are required and the oil carried by the media is only about 1-10 mg per A4 size page. In one possible embodiment, the mid-heater 30 and spreader 40 can be combined into a single unit, with their respective functions occurring relative to the same portion of media simultaneously. In another embodiment the media is maintained at a high temperature during the printing operation to enable the spreader 40 to spread the ink while the ink is in a liquid or semi-liquid state. Following passage through the spreader 40 the printed media can be wound onto a roller for removal from the system.

Operation and control of the various subsystems, components and functions of the printer 5 are performed with the aid of the controller 50. The controller 50 is implemented with general or specialized programmable processors that execute programmed instructions. The instructions and data required to perform the programmed functions are stored in a memory that is operatively connected to the controller 50. The memory includes volatile data storage devices such as random access memory (RAM) and non-volatile data storage devices including magnetic and optical disks or solid state storage devices. The processors, their memories, and interface circuitry configure the controllers and the print engine to perform functions that compensate for malfunctioning inkjets as described below. These components are provided on a printed circuit card or provided as a circuit in an application specific integrated circuit (ASIC). In one embodiment, each of the circuits is implemented with a separate processor device. Alternatively, the circuits can be implemented with discrete components or circuits provided in VLSI circuits. Also, the circuits described herein can be implemented with a combination of processors, ASICs, discrete components, or VLSI circuits. As described in more detail below, the controller 50 executes stored program instructions stored in the memory to compensate for malfunctioning inkjets in printheads within the color units 21A-21D.

The printer 5 includes an optical sensor 54 that is configured to generate image data corresponding to the media web 14. The optical sensor is configured to generate signals indicative of reflectance levels of the media, ink, or backer roll opposite the sensor to enable detection of malfunctioning inkjets in the color units 21A-21D. The optical sensor 54 includes an array of optical detectors mounted to a bar or other longitudinal structure that extends across the width of an imaging area on the image receiving member. In one embodiment in which the imaging area is approximately twenty inches wide in the cross-process direction and the printheads print at a resolution of 600 dpi in the cross-process direction, over 12,000 optical detectors are arrayed in a single row along the bar to generate a single scanline of image data corresponding to a line across the image receiving member. The optical detectors are configured in association with one or more light sources that direct light towards the surface of the image receiving member. The optical detectors receive the light generated by the light sources after the light is reflected from the image receiving member, such as the media web 14. The magnitude of an electrical signal generated by an optical detector corresponds to the amount of light reflected into the detector from the surface of the media web 14, including bare portions of the media web surface and portions that carry printed ink patterns. The magnitudes of the electrical signals generated by the optical detectors are converted to digital values by an appropriate analog/digital converter.

As used herein, "adjacent" means that the datum corresponding to an ejector selected to compensate for a malfunctioning ejector is sufficiently close to the datum corresponding to the malfunctioning ejector that ejecting a drop from the compensating ejector satisfactorily contributes compensation for failure of the inoperative ejector to eject a drop. For example, in some printer systems, satisfactory compensation is achieved by selecting as compensating ejectors, ejectors that eject drops within three ink drop positions from the position at which the inoperative ejector would have ejected a drop. The term "immediately adjacent" refers to a datum that borders a particular datum corresponding to a malfunctioning ejector. As described below, the immediately adjacent datum can correspond to another ejector in another printhead that ejects drops of a color or material that is different than the color or material of the drops that would have been ejected by the malfunctioning ejector.

While the printer 5 has been described in detail to provide an environment in which the compensation method described below can be used, the method can also be used effectively in other printers. For example, the method can be used in printers that form images on cut sheets, rather than a continuous web. Additionally, printer 5 has a sufficient number of printheads arranged in a cross-process direction across the media to enable the entire width of the media to be printed as it passes the printhead assemblies. The compensation method described below can be used in printers having fewer printheads arranged in the cross-process direction that are operatively connected to actuators that are configured to move the printheads across the media to enable the printheads to print the full width of the media. The media transport in such printers is also configured to hold the media at a position opposite the printheads to enable the printing of a continuous line and then move the media to enable a next line to be printed across the full width of the media. The method can also be used in printers that eject materials for forming layers of a three-dimensional object. Such printers are commonly called three-dimensional object printers or simply 3D printers.

A method 200 that can be implemented by the printer of FIG. 3 is shown in FIG. 1. In the description below, a reference to the process 200 performing an action or function refers to the operation of a controller, such as the controller 50, to execute stored program instructions to perform the function or action in association with other components in an inkjet printer. The process 200 is described in conjunction with the printer 100 of FIG. 1 for illustrative purposes. As used in this document, "pixel" means a position on an ink receiving surface that receives one or more drops of overlapping ink to form a colored dot on the surface. For each pixel in an output image on the ink receiving member, the input image has a tuple of color space components used to form a color at the pixel. Each color space component is defined by a contone value. As used in this document, "contone value" refers to a digital numerical value, which is represented by more than one digital bit. Typically, a contone value is a digital numerical value in a range of 0 to 255, although other ranges can be used, such as 0 to 128 or 0 to 1024.

The process 200 begins with the identification of the malfunctioning inkjets in the printer in a known manner (block 204). The contone values for the color space components of a compensation level for each malfunctioning inkjet are identified by theoretical calculations based on a color model or from a look-up table of empirical data (block 208). Each compensation level is a single tuple of color space components that represents a color that best replaces the original contone color space component associated with the malfunctioning inkjet that cannot be ejected by the malfunctioning inkjet. In one embodiment, the contone values for the color space components for a compensation level are identified with reference to an average of the numerical values for the corresponding contone values of color space components in an area of the input image about the malfunctioning inkjet. For example, the contone values for the color space components arranged in a 3 by 7 area centered about the contone value associated with a malfunctioning inkjet are summed and divided by the total number (21) of values in the area to identify an average contone value for the corresponding color in the area about the selected contone value and this average contone value is used in the compensation level. While this example selects all of the contone values, not all of the contone values need be used and the contone values need not be contiguously positioned about the contone value for the malfunctioning inkjet. In another embodiment, the compensation level is identified with reference to the selected contone value associated with the malfunctioning inkjet. Using this value alone to identify the contone values for the color space components in the compensation level assumes the selected contone value is representative of all of the contone values in the area and would be close to an average value for the area if the average contone value was computed as previously described. In both of these embodiments, a look-up table (LUT) is used to identify the contone values for the color space components in the compensation level. The input to the LUT is the average contone value or the selected contone value and the output is the contone value for a color space component in the compensation level. Alternatively, instead of a LUT, a calculation or interpolation of sparse sample points (e.g., spline knots) can be used to identify the appropriate contone values for the compensation level corresponding to the malfunctioning inkjet. The output data in these implementations can be determined empirically or algorithmically.

Since the color space components in the compensation level may be provided by printheads other than the one in which the malfunctioning inkjet is located, the registrations between the compensation level components and the original color space component associated with the malfunctioning inkjet may be imperfect. This imperfection in registration produces a positional error at the location where the compensation level component is marked. This error is the distance between the correct position of a printhead that marks a compensation level contone color space component and the actual position where the compensation level contone color space component is marked. To compensate for this positional error, a profile is selected for each color space component in the compensation level tuple that is large enough to cover the malfunctioning jet despite the registration distance error (block 208). For a three-dimensional (3D) object printer this profile can be configured to cover a three-dimensional volume, a two-dimensional plane, or a one-dimensional line of contone values in the vicinity of the compensation level depending on the dimensionality of the positional error. For a two-dimensional media printer the profile can be configured to cover a one or two-dimensional area around the compensation level depending on the dimensionality of the positional error. The extended volume, area, or length of the selected profile must ensure that the location that corresponds to the malfunctioning inkjet is covered despite the positional error. Thus, the profile consists of a three-dimensional, two-dimensional, or one-dimensional array of weights that are multiplied by the contone values for the color space components in the compensation level tuple to produce the compensating level that is applied to the original color space component associated with the malfunctioning inkjet.

Figure 2:
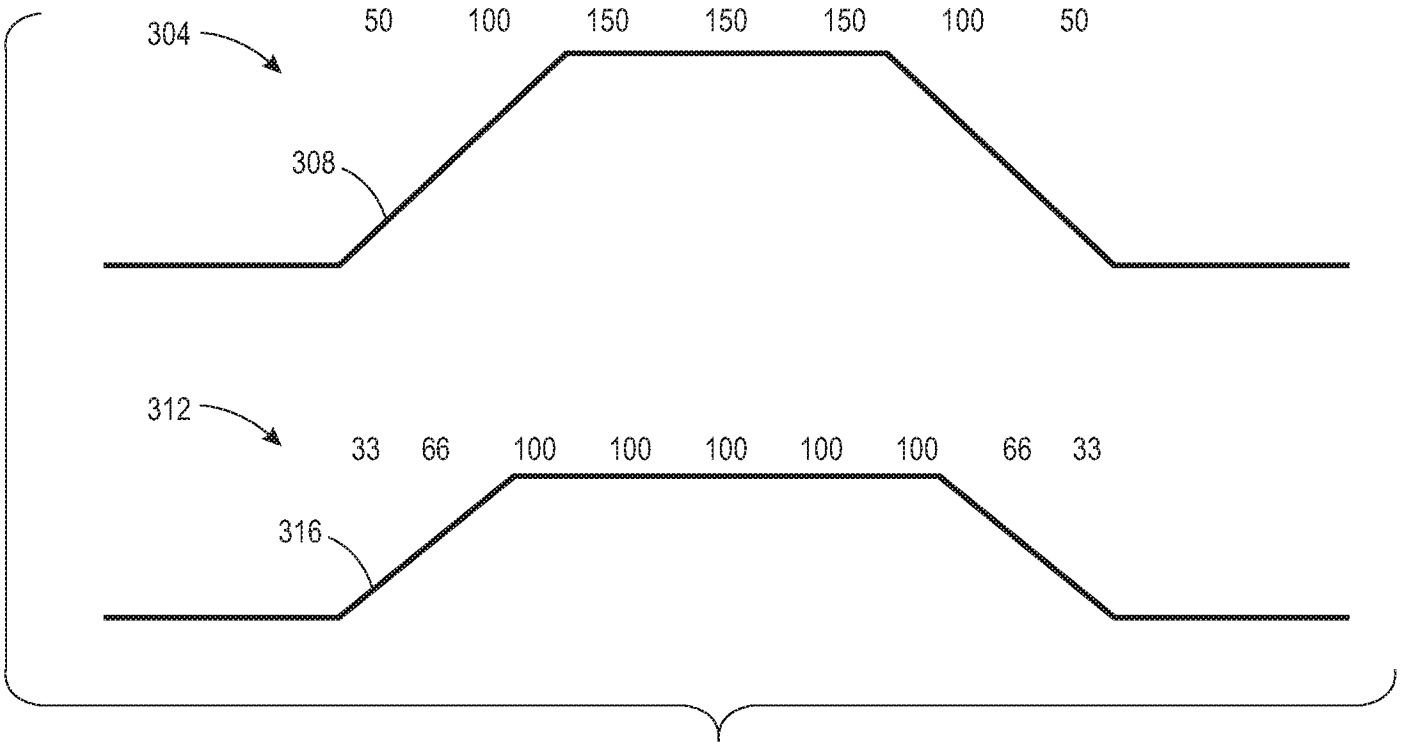
FIG. 2 is a depiction of two compensating profiles and the waveforms that they represent.

An example of two one-dimensional profiles is shown in FIG. 2. Profile 304 has seven multipliers in which the first weight is 50, the second weight is 100, the next three weights are 150, the sixth weight is 100 and the seventh weight is 50. Profile 312 has nine weights in which the first weight is 33, the second weight is 67, the next five weights are 100, the sixth weight is 67 and the seventh weight is 33. These profiles help shape the amplitudes of the contone values in the area of the contone value associated with the malfunctioning inkjet to avoid highly visible high frequency pixels at sharp contrast edges. The second profile 312 is longer, but it has a lower amplitude than the first profile 308 as the amplitude of a compensating profile is scaled inversely to its width so the integrated response of a human eye to the image in the compensated area remains constant as the width of the profile varies. The amplitude of the color space component values in the compensation level tuple for each malfunctioning inkjet are adjusted based on the profile dimensions and weights to achieve the appropriate level of correction (block 212).

In some printers, an image is dispersed over two or more printheads in a configuration known as interleaved or split-screen printing. In these printers, a symmetric profile corresponding to an even number of weights can be used. A symmetric profile means each amplitude used in the profile has an even number of weights at that amplitude. For example, a profile having the weights 50 50 100 100 150 150 150 150 100 100 50 50 comports with these requirements. This profile enables an area having a relatively low number of contone values in the split-screen region of an input image to drop either the contone values of the input image at the even-numbered or the odd-numbered positions depending on the contone values in the input image.

The tuples of the contone values in the compensation levels are then evaluated and adjusted with reference to the contone values of the input image and the contone values of the output image, which would be produced if the contone values of the compensating levels were fully applied to the input image (block 216). This evaluation and adjustment ensures that image features, such as high contrast edges or small image features, are not destroyed, and that overall image density on a pixel basis is not modified by an excessive amount that would adversely impact the perceived image quality.

The modified contone values of the compensating levels are merged with the contone values of the input image to form the contone values for the output image (block 224). This modification can be implemented by adding the modified contone values of the compensating levels with the contone values for the input image, but other merging operations can be used for the merger of the modified contone values of the compensating levels with the contone values of the input image. The resulting contone values for the output image are then rendered (block 228) and the relocation compensation method is applied to the rendered data (block 232). As used in this document, "rendered data" refer to contone values that have been processed to produce data that are used to operate inkjets in one or more printheads in the printer to achieve the appearance specified by the contone values in the input image. These rendered data are used to generate the firing signals that operate the inkjets in the printheads to produce an ink image (block 236). Also, as used in this document, "relocation compensation method" means a known compensation technique applied to rendered data that moves a rendered data value associated with a malfunctioning inkjet to another location in a neighborhood around the rendered data value associated with the malfunctioning inkjet or that modifies a rendered data value in the neighborhood around the rendered data value associated with the malfunctioning inkjet with reference to the rendered data value associated with the malfunctioning inkjet.

To implement the method in a printer, a controller, such as controller 50, is configured by storing programmed instructions in a memory operatively connected to the controller. As the controller executes the instructions, contone values for an image are received and data identifying malfunctioning inkjets are generated. The contone values are processed by the controller to identify the contone values for the color space components for a compensation level for each malfunctioning inkjet and the contone values of the compensation levels are used to produce modified contone values for the output image. These contone values are rendered to produce halftoned image data and the relocation compensation method is applied to the halftoned data to produce modified halftoned data, which are used to generate firing signals for operating the inkjets in the printheads to eject ink and form an ink image. Because the compensation level blends the two compensating methods, the contone compensation method has a dominating effect in areas where the number of non-zero contone values of the input image interferes with the effectiveness of the relocation method and the relocation method is more prevalent in areas where the number of contone values in the input image is lower.

It will be appreciated that variants of the above-disclosed and other features and functions, or alternatives thereof, may be desirably combined into many other different systems, applications or methods. Various presently unforeseen or unanticipated alternatives, modifications, variations, or improvements therein may be subsequently made by those skilled in the art, which are also intended to be encompassed by the following claims.

What is claimed is:

1. A method of controlling a printer comprising:

receiving a plurality of contone values for an image to be formed by the printer;

receiving data identifying malfunctioning inkjets in the printer;

modifying contone values within the plurality of contone values that are positioned about each contone pixel corresponding to one of the malfunctioning inkjets identified by the received data to produce modified contone values for the image to be formed by the printer;

rendering the modified contone values and the contone values in the plurality of contone values to produce rendered data; and operating inkjets within the printer with reference to the rendered data to eject ink and form the image.

2. The method of claim 1 further comprising:

identifying a compensation level for each contone pixel corresponding to one of the malfunctioning inkjets.

3. The method of claim 2, the identification of the compensation level for each contone pixel corresponding to one of the malfunctioning inkjets further comprising:

identifying a contone value for each color space component in the compensation level for each contone pixel corresponding to one of the malfunctioning inkjets with reference to a contone value corresponding to the contone values positioned about the contone pixel corresponding to one of the malfunctioning inkjets.

4. The method of claim 3, the identification of the contone values for the color space components in the compensation level for each contone pixel corresponding to one of the malfunctioning inkjets further comprising:

identifying the contone values in the compensation level with reference to an average contone value for the contone values positioned about the contone value corresponding to one of the malfunctioning inkjets.

5. The method of claim 4 further comprising:

selecting a profile for each contone pixel corresponding to one of the malfunctioning inkjets in the plurality of contone values; and modifying the contone values in the compensation level corresponding to the malfunctioning inkjet used to select the profile with reference to the profile selected for the malfunctioning inkjet.

6. The method of claim 5, the profile selection further comprising:

selecting a symmetric profile having an even number of weights with each weight value in the profile being represented by an even number of weights.

7. The method of claim 5, the profile selection further comprising:

selecting a one-dimensional profile.

8. The method of claim 5, the modification of the contone values in the compensation level for each malfunctioning inkjet further comprising:

modifying the contone values in the compensation levels with reference to an application of the contone values in each compensation level to the contone values positioned about the malfunctioning inkjet corresponding to the compensation level.

9. The method of claim 1, the modification of the contone values positioned about each malfunctioning inkjet further comprising:

merging the contone values in the compensation level for each malfunctioning inkjet with the received contone values positioned about each malfunctioning inkjet.

10. The method of claim 1 further comprising:

applying relocation compensation to the rendered data before operating the inkjets.

11. A printer comprising:

a plurality of printheads configured to eject inks of different colors;

a memory configured to store a plurality of contone values for forming an image with ink ejected by the plurality of printheads and data identifying malfunctioning inkjets in the printer; and a controller operatively connected to the plurality of printheads and the memory, the controller configured to:

receive from the memory a plurality of contone values for an image to be formed by the printer;

receive from the memory data identifying malfunctioning inkjets in the printer;

modify contone values within the plurality of contone values that are positioned about each contone pixel corresponding to one of the malfunctioning inkjets identified by the received data to produce modified contone values for the image to be formed by the printer;

render the modified contone values and the contone values in the plurality of contone values to produce rendered data; and operate inkjets within the printer with reference to the rendered data to eject ink and form the image.

12. The printer of claim 11, the controller being further configured to:

identify a compensation level for each contone pixel corresponding to one of the malfunctioning inkjets.

13. The printer of claim 12, the controller being further configured to:

identify a contone value for each color space component in the compensation level for each malfunctioning inkjet with reference to a contone value corresponding to the contone values positioned about the contone pixel corresponding to the malfunctioning inkjet.

14. The printer of claim 13, the controller being further configured to:

identify the contone values in the compensation level for each malfunctioning inkjet with reference to an average contone value for the contone values positioned about the contone value corresponding to the malfunctioning inkjet.

15. The printer of claim 14, the controller being further configured to:

select a profile for each contone pixel corresponding to one of the malfunctioning inkjets in the plurality of contone values; and modify the contone values in the compensation level corresponding to the malfunctioning inkjet used to select the profile with reference to the profile selected for the malfunctioning inkjet.

16. The printer of claim 15, the controller being further configured to select a profile by:

selecting a symmetric profile having an even number of weights with each weight value in the profile being represented by an even number of weights.

17. The printer of claim 15, the controller being further configured to select a profile by:

selecting a one-dimensional profile.

18. The printer of claim 15, the controller being further configured to modify the contone values in the compensation level for each malfunctioning inkjet by:

modifying the contone values in the compensation levels with reference to an application of the contone values in each compensation level to the contone values positioned about the malfunctioning inkjet corresponding to the compensation level.

19. The printer of claim 11, the controller being further configured to modify the contone values positioned about each malfunctioning inkjet by:

merging the contone values in the compensation level for each malfunctioning inkjet with the received contone values positioned about each malfunctioning inkjet.

20. The printer of claim 11, the controller being further configured to:

apply relocation compensation to the rendered data before operating the inkjets.

* * * * *